US007794265B2

(12) United States Patent
Sikora

(10) Patent No.: US 7,794,265 B2
(45) **Date of Patent: *Sep. 14, 2010**

(54) BATTERY POST ELECTRICAL TERMINAL ASSEMBLY

(75) Inventor: Ken Sikora, Fort Wayne, IN (US)

(73) Assignee: Group Dekko, Inc., Kendallville, IN (US)

( * ) Notice: Subject to any disclaimer, the term of this patent is extended or adjusted under 35 U.S.C. 154(b) by 86 days.

This patent is subject to a terminal disclaimer.

(21) Appl. No.: 12/412,121

(22) Filed: Mar. 26, 2009

(65) Prior Publication Data

US 2009/0186515 A1 Jul. 23, 2009

Related U.S. Application Data

(63) Continuation of application No. 12/115,107, filed on May 5, 2008, now Pat. No. 7,549,889.

(60) Provisional application No. 60/915,951, filed on May 4, 2007.

(51) Int. Cl.
*H01R 4/24* (2006.01)

(52) U.S. Cl. ..... 439/388

(58) Field of Classification Search ..... 439/388, 439/883, 859, 439

See application file for complete search history.

(56) References Cited

U.S. PATENT DOCUMENTS

| | | | | |
|---|---|---|---|---|
| 1,994,251 | A | 3/1935 | Mueller | |
| 4,795,380 | A | 1/1989 | Frantz | |
| 4,830,624 | A | 5/1989 | Rose et al. | |
| 4,969,832 | A | 11/1990 | Fry | |
| 5,733,152 | A | 3/1998 | Freitag | |
| 6,764,353 | B2 | 7/2004 | Freitag | |
| 6,817,908 | B2 | 11/2004 | Freitag | |
| 6,855,008 | B1 | 2/2005 | Freitag et al. | |
| 6,932,650 | B1 | 8/2005 | Freitag | |
| 7,189,122 | B2 | 3/2007 | Freitag | |
| 7,549,889 | B2 * | 6/2009 | Sikora | 439/388 |
| 2007/0264883 | A1 | 11/2007 | Freitag | |

FOREIGN PATENT DOCUMENTS

| | | | |
|---|---|---|---|
| WO | 2006096242 | A1 | 9/2006 |

* cited by examiner

*Primary Examiner*—Phuong K Dinh
(74) *Attorney, Agent, or Firm*—Taylor IP, P.C.

(57) ABSTRACT

A battery post electrical terminal assembly includes: an electrical terminal configured for coupling with an electrical conductor; and a retainer snap-fittingly engaged with the electrical terminal and including a plurality of fingers, the plurality of fingers configured for frictionally engaging a battery post of a battery and thereby configured for mechanically and electrically coupling the retainer with the battery post.

5 Claims, 4 Drawing Sheets

BATTERY POST ELECTRICAL TERMINAL ASSEMBLY

CROSS REFERENCE TO RELATED APPLICATIONS

This is a continuation of U.S. patent application Ser. No. 12/115,107, entitled "BATTERY POST ELECTRICAL TERMINAL ASSEMBLY", filed May 5, 2008 now U.S. Pat. No. 7,549,889, which is incorporated herein by reference and which is a non-provisional application based upon U.S. provisional patent application Ser. No. 60/915,951, entitled "BATTERY POST ELECTRICAL TERMINAL ASSEMBLY", filed May 4, 2007, which is incorporated herein by reference.

BACKGROUND OF THE INVENTION

1. Field of the Invention

The present invention relates to electrical terminals, and, more particularly, to electrical terminals for battery posts.

2. Description of the Related Art

Automobiles, for instance, carry their own source of electrical power, a battery. That battery then supplies, via electrical conductors, power to various aspects of the vehicle. The battery has an electrical post which couples with an electrical terminal. A disadvantage exists, however, in having to use tools to connect the electrical terminal with the battery post.

What is needed in the art is a battery post electrical terminal assembly which simply, easily, and reliably provides for mechanical and electrical coupling with a battery post using an interference fit and thus without tools.

SUMMARY OF THE INVENTION

The present invention provides a battery post electrical terminal assembly which simply, easily, and reliably provides for mechanical and electrical coupling with a battery post using an interference fit and thus without tools.

The invention in one form is directed to a battery post electrical terminal assembly which includes an electrical terminal and a retainer connected to the electrical terminal. The electrical terminal is configured for coupling with an electrical conductor. The retainer includes a plurality of fingers, the plurality of fingers configured for frictionally engaging a battery post of a battery and thereby configured for mechanically and electrically coupling the retainer with the battery post.

The invention in another form is directed to a method of mounting a battery post electrical terminal assembly to a battery post of a battery. The method includes the steps of providing, coupling, connecting, pressing, and engaging. The providing step provides that the battery post electrical terminal assembly includes an electrical terminal and a retainer. The coupling step couples the electrical terminal with an electrical conductor. The connecting step connects the retainer to the electrical terminal, the retainer including a plurality of fingers. The pressing step presses the retainer onto the battery post. The engaging step engages the plurality of fingers frictionally with the battery post and thereby mechanically and electrically couples the retainer with the battery post.

An advantage of the present invention is that it provides a friction fit design for coupling an electrical terminal with a battery post.

Another advantage is that the battery post electrical terminal assembly is easy to assemble and disassemble.

Yet another advantage is that the battery post electrical terminal assembly can be assembled on a battery post without having to use tools.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
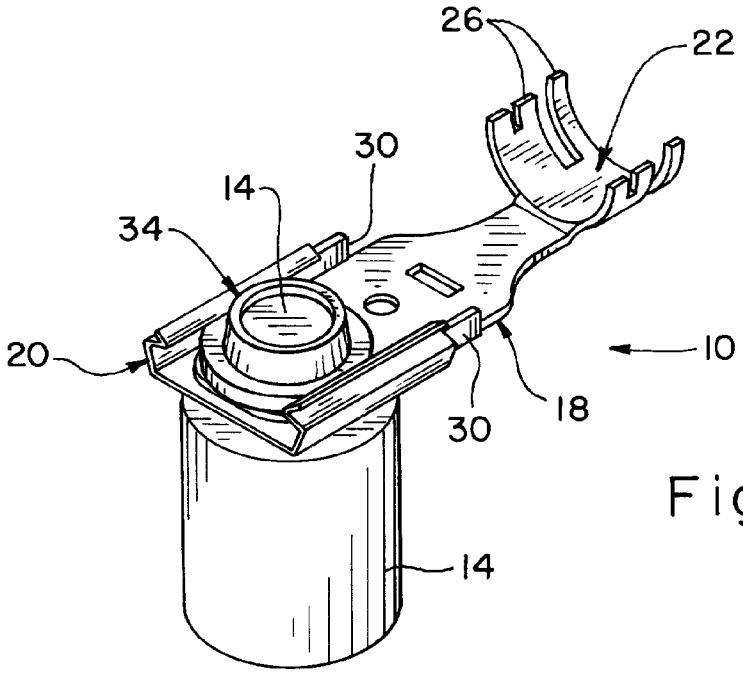
FIG. 1 is a perspective view of the battery post electrical terminal assembly according to the present invention mounted on a battery post.

Referring now to the drawings, and more particularly to FIGS. 1-4 and 7, there is shown an electrical system 9 including a battery post electrical terminal assembly 10, an electrical conductor 12 (in the form of, for example, cabling or wiring) coupled with assembly 10, a battery post 14 of a battery 16 (battery post 14 being coupled with assembly 10), and an electrical load 17. Battery post electrical terminal assembly 10 generally includes an electrical terminal 18 and a retainer 20. Electrical system can be for a self-propelled device such as an automobile, or the like, but is not limited to self-propelled devices.

Figure 6:
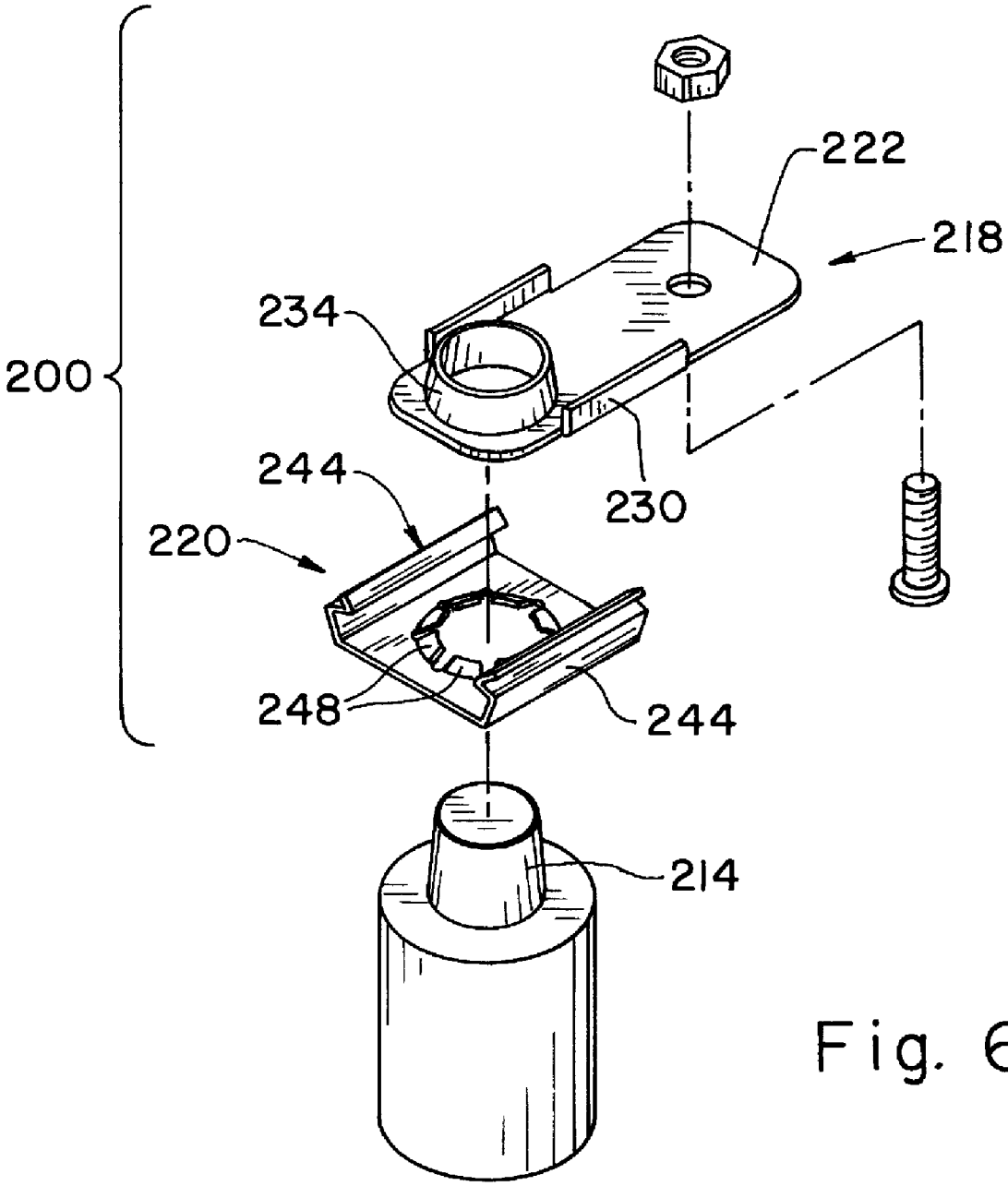
FIG. 6 is an exploded, perspective view of yet another embodiment of the battery post electrical terminal assembly according to the present invention dismounted from the battery post.

Electrical terminal 18 is made of, in whole or in part, electrically conductive material, such as copper. Electrical terminal 18 generally has a longitudinal extent and includes an electrical conductor coupling end 22 and a battery post coupling end 24. Electrical conductor coupling end 22 includes one or more features for attaching terminal 18 to electrical conductor 12 in a suitable manner. For instance, FIG. 1 shows arms 26 for folding so as to crimp or otherwise hold electrical conductor 12 to terminal 18. FIG. 6 shows a conductor coupling end 222 that employs a flat plate in conjunction with a bolt and nut arrangement for clamping an electrical conductor to that flat plate. The electrical conductor could be soldered to the terminal.

Battery post coupling end 24 of terminal 18 has a generally rectangular shape and thus includes a substantially flat plate 28 with two parallel longitudinal sides. Each longitudinal side includes an upstanding wall 30 running parallel to one another and formed generally perpendicular to plate 28. Each upstanding wall 30 runs a portion of the longitudinal sides of battery post coupling end 24. Plate 28 defines a mounting through-hole 32 for receiving battery post 14 therethrough. Mounting through-hole 32 can be generally circular in shape.

Assembly further includes a collar 34. Collar 34 is either monolithic or discrete relative to electrical terminal 18. "Monolithic" is intended to mean that collar 34 and terminal 18, for example, are a single piece. "Discrete" is intended to mean that collar 34 and terminal 18, for example, are two pieces and as such are individual parts; as individual parts, however, collar 34 and terminal 18 can be positioned adjacent and in contact with each other. Collar 34 includes a platform 36 and an upstanding wall 38 projecting from platform 36, platform 36 and upstanding wall 38 together including a bore 40 therethrough, bore 40 being used to mount collar 34 to battery post 14. Bore 40 can have a tapering diameter which decreases as bore 40 runs from the region of platform 36 to the distal extent of upstanding wall 38 (that being the trailing edge of wall 38 relative to an insertion direction of post 14 in bore 40), battery post 14 being inserted in bore 40 in the platform 36 region of bore 40; this tapering thus serves to ease insertion of post 14 into bore 40. When collar 34, terminal 18, and retainer 20 are mounted together to battery post 14 (as explained more fully below), collar 34 is positioned atop terminal 18, which is itself positioned atop retainer 20. Further, collar 34, at least in part, serves to stabilize the coupling between retainer 20 and terminal 18 by removing play when upstanding walls 30 of terminal 18 are mounted within catches 52 of retainer 20 and to stabilize the coupling of terminal 18 and retainer 20 to post 14. Collar 34 can be electrically conductive. Collar 34 is symmetrical in a plan view, having two opposing, parallel longitudinal sides which mount within mounting springs 44 of retainer 20 and also two rounded ends which mirror each other, the rounded portions extending between each longitudinal side.

Figure 2:
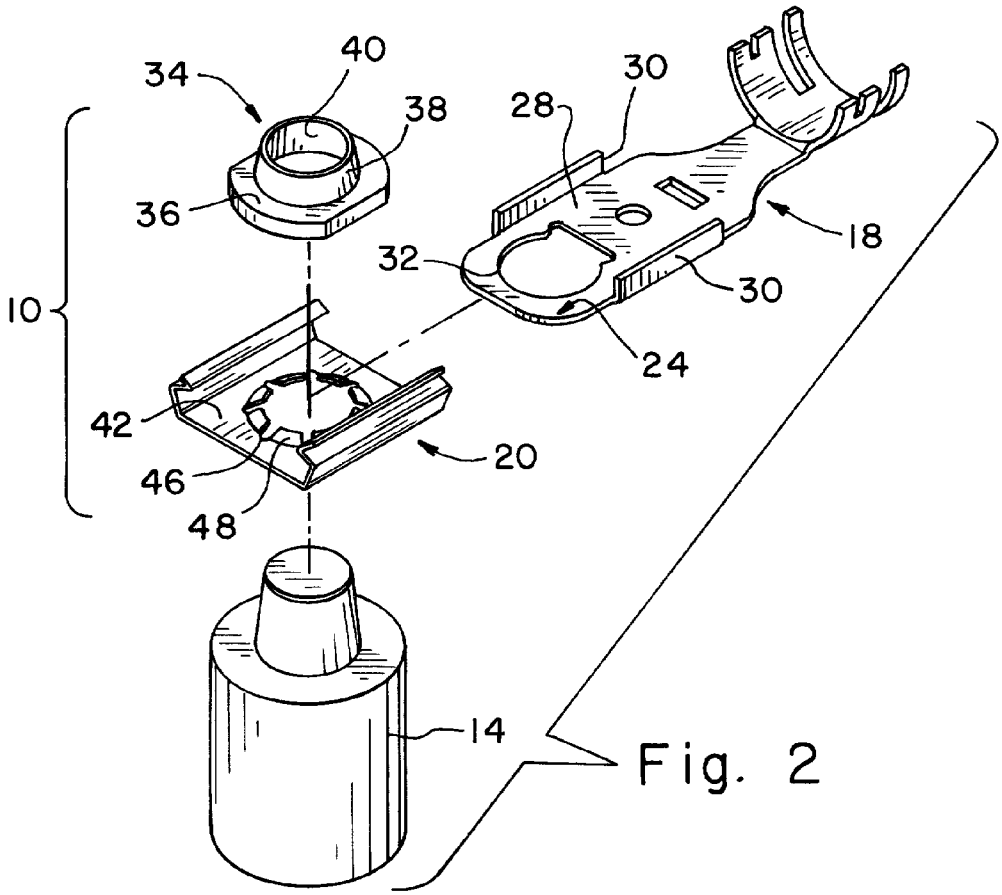
FIG. 2 is an exploded, perspective view of the battery post electrical terminal assembly of FIG. 1 dismounted from the battery post.
Figure 3:
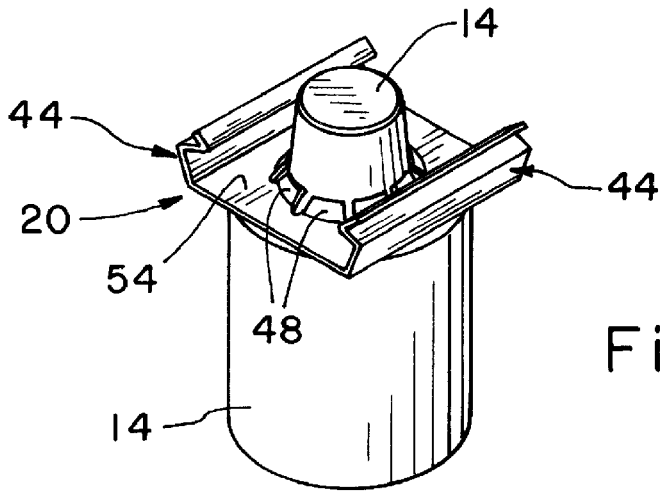
FIG. 3 is a perspective view of the retainer of the battery post electrical terminal assembly of FIG. 1 mounted on the battery post.
Figure 7:
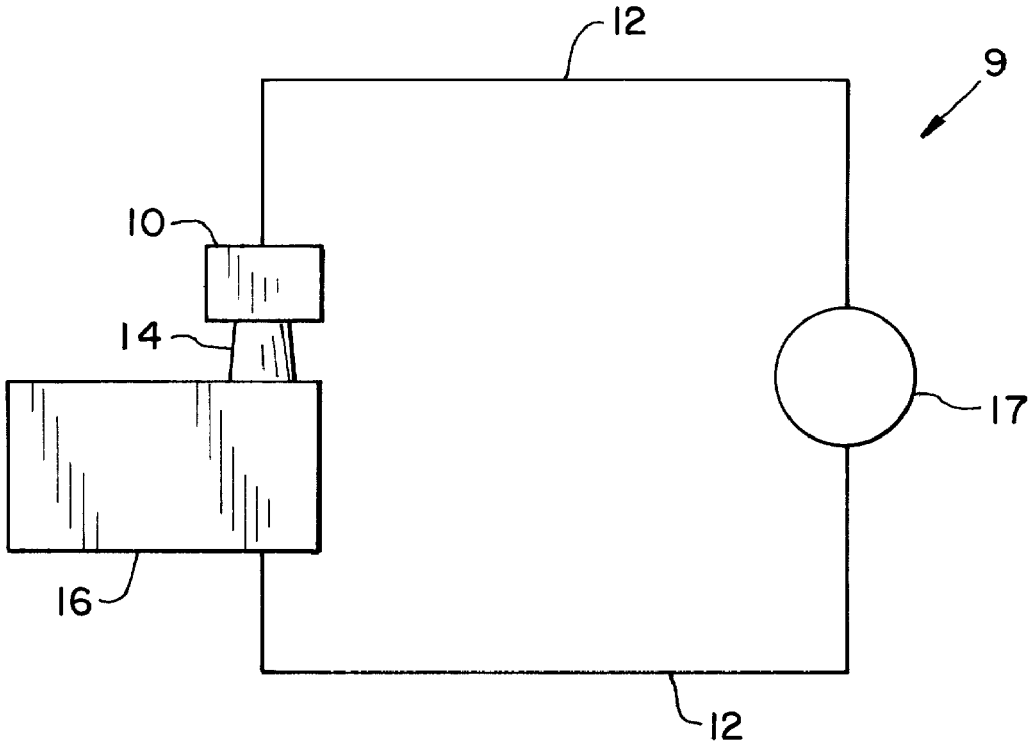
FIG. 7 schematically shows an electrical system including the battery post electrical terminal assembly according to the present invention mounted to a battery post of a battery and coupled with an electrical conductor.
Figure 4:
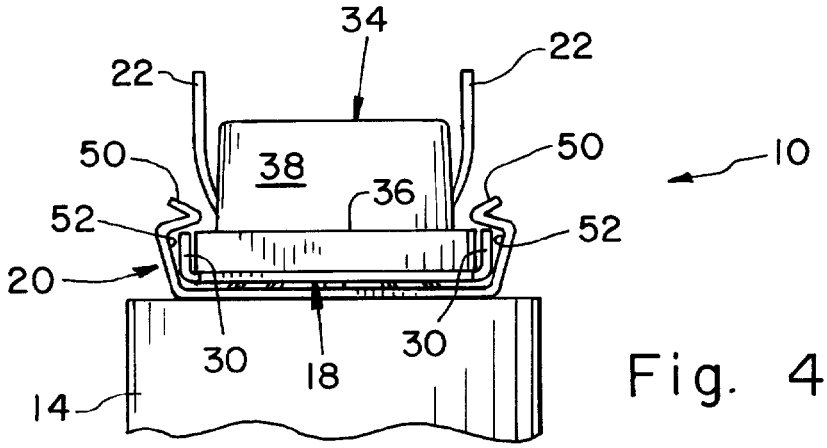
FIG. 4 is a front end elevation view of the battery post electrical terminal assembly of FIG. 1 mounted on the battery post.

Retainer 20 can have a generally square shape and be made of spring steel. Retainer 20 is electrically conductive. Retainer 20 can be monolithic. Retainer 20 connects to battery post 14, electrical terminal 18, and collar 34. Retainer 20 includes a substantially flat plate 42 and two mounting springs 44 each positioned along a corresponding edge of plate 42. Plate 42 defines a mounting through-hole 46 for receiving and mounting retainer 20 to battery post 14, post 14 being inserted through mounting hole 46 as retainer 20 is pushed down onto post 14. Mounting hole 46 can be centered on flat plate 42, as shown in the drawings. Plate 42 forms several fingers 48 which frictionally engage battery post 14 and thereby mechanically and electrically couple retainer 20 with battery post 14. Fingers 48 are spaced apart from one another, arranged in a circle relative to one another, and project into mounting hole 46 (that is, fingers 48 project inwardly relative to mounting hole 46). Stated another way, fingers 48 extend radially inwardly and form teeth or spring teeth which can dig into post 14 when retainer 20 is pushed down onto post 14. It is noted that mounting hole 46 can vary in diameter depending upon the extent to which battery post 14 displaces or deforms fingers 48 when retainer 20 is mounted to post 14, the greatest diameter being if each finger deflects vertically or perpendicularly to plate 42 when mounting hole 46 receives post 14. However, the diameter of mounting hole 46 should be less than this greatest diameter because fingers 48 should deflect only partly from the horizontal plane 54 formed by plate 42 (when post 14 is inserted into mounting hole 46), not completely to the vertical position. Thus, fingers 48 project from plate 42 toward battery post 14, fingers 48 being angled relative to a plane 54 of plate 42 and thereby securing retainer 20 to battery post 14. Fingers 48 deflect somewhat upwardly or in a direction generally opposing removal of retainer 20 from post 14. As such, fingers 48 help to prevent retainer 20 from accidentally detaching from post 14. Fingers 48 can be deformed by battery post 14 when mounting hole 46 receives post 14. Noted is that fingers 48, in FIG. 2 are shown as already being deflected upwardly, for illustrative purposes. However, before mounting retainer 20 to post 14, fingers 48 may not yet be deflected upwardly but may still lie in plane 54 of plate 42 until post 14 deflects fingers 48 upwardly during insertion of post 14 in mounting hole 46.

Mounting springs 44 of retainer 20 are substantially identical and thus the description of one mounting spring 44 serves to describe the other. Mounting spring 44 snap-fittingly engages a corresponding upstanding wall 30 of terminal 18. Mounting spring 44 can also snap-fittingly engage platform 36 of collar 34. Each mounting spring 44 runs substantially parallel to one another. Mounting spring 44 includes a diagonally upwardly facing skid 50 connected to a catch 52. Skid 50 serves to ease insertion of terminal 18 and collar 34 into catch 52; terminal 18, for instance, can slide along skid 50 until it falls into catch 52, mounting spring 44 being displaced as terminal 18 slides along skid 50; skid 50 can also be depressed by an end-user to withdraw terminal 18 and/or collar 34 from catch 52. Catch 52 serves to catch and hold upstanding wall 30 of terminal 18 and can catch and hold a portion of platform 36 of collar 34. Each catch 52 has an open end generally facing the open end of the other catch 52.

It is noted that retainer 20 and terminal 18 (with a monolithic collar 34) can be supplied to an end-user as a one-piece assembly. Alternatively, retainer 20 and terminal 18 (with a monolithic collar 34) can be supplied to an end-user as a two-piece assembly. Alternatively, retainer 20, terminal 18, and collar 34 can be supplied to an end-user as a three-piece assembly.

In use, retainer 20, terminal 18, and collar 34 are mounted and secured to battery post 14. At least one electrical conductor 12 can be crimped and secured to terminal 18 in a suitable manner. Battery post 14 is inserted through mounting hole 46 of retainer 20, and retainer 20 is pushed down onto post 14. In so doing, fingers 48 deflect somewhat upwardly and can dig into post 14. The deflection of fingers 48 makes it difficult for retainer 20 (and thus assembly 10) to come off of post 14 accidentally. Fingers 48 thus provide mechanical connection to post 14 and serve as electrical contacts to post 14. Terminal 18 can then be mounted to post 14 and to retainer 20. Terminal 18 is pushed down onto post 14 via mounting hole 32 of terminal 18. Alternatively, one upstanding wall 30 of terminal 18 can first be positioned within catch 52 and then post 14 can be inserted into mounting hole 32 of terminal 18. Either way, one upstanding wall 30 of terminal 18 can first be secured within a corresponding catch 52; then the other upstanding wall 30 of terminal 18 can be secured within the other catch 52 using skid 50. As such, terminal 18 snap-fits to mounting springs 44. Collar 34 can then be placed down onto battery post 14 through its bore 40. Platform 36 of collar 34 can snap-fit within catch 52 using skids 50 to secure assembly 10 together to post 14. Alternatively, terminal 18 and retainer 20 can first be snap-fitted together and then together placed onto battery post 14. As such, mounting through-hole 46 of retainer 20, mounting through-hole 32 of electrical terminal 18, and bore 40 of collar 34 are aligned when battery post electrical terminal assembly 10 is coupled with battery post 14. As such, terminal assembly 10 mechanically and electrically couples to post 14, thereby providing electrical connection between conductor 12 and battery 16. It is noted that directional terminology such as "up" and "down" are made herein in reference to a battery post 14 seated on a horizontal plane and extending in a vertical direction. It is understood that in use battery post 14 and assembly 10 may be angled to any degree from the horizontal plane.

Figure 5:
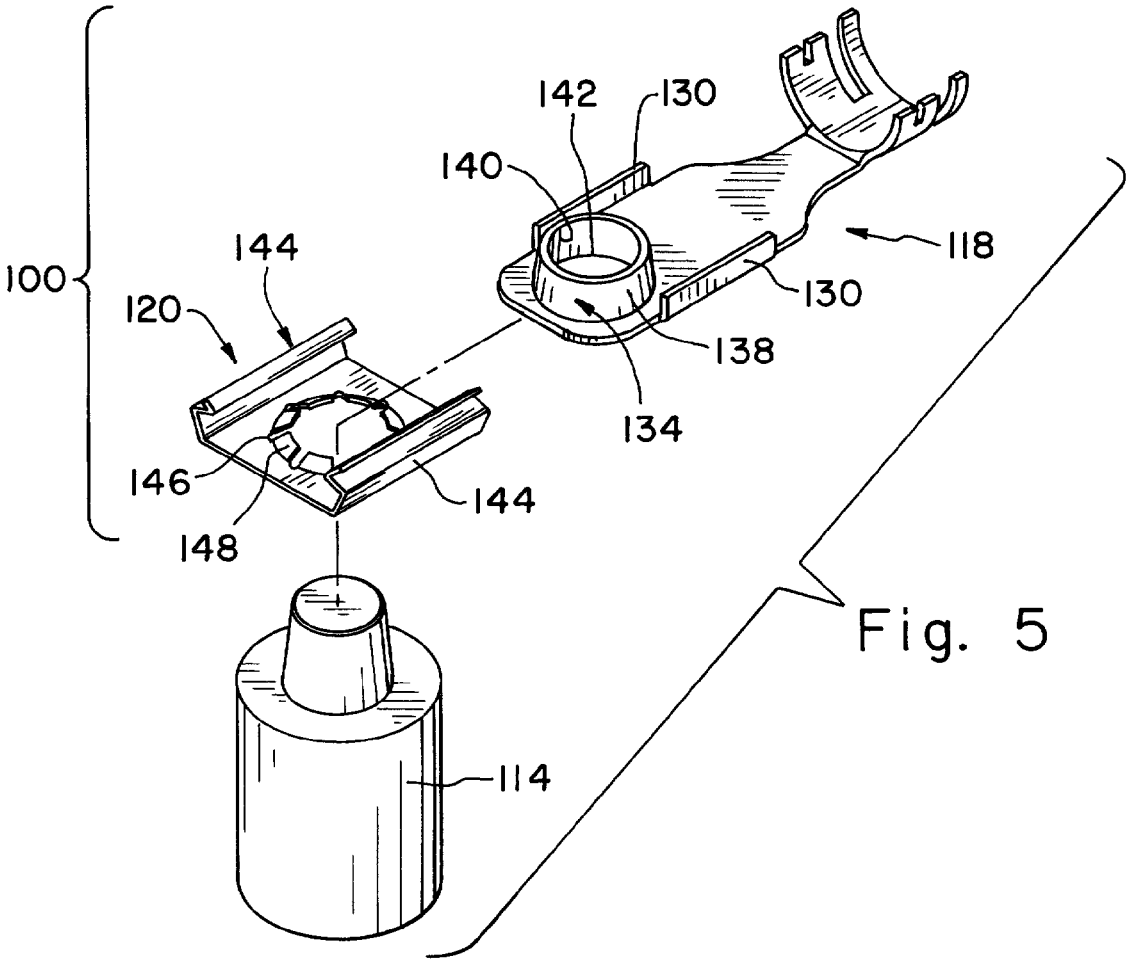
FIG. 5 is an exploded, perspective view of another embodiment of the battery post electrical terminal assembly according to the present invention dismounted from the battery post.

FIG. 5 shows another embodiment of the present invention. Reference characters of the embodiment shown in FIG. 5 corresponding to reference characters of the embodiment shown in FIGS. 1-4 are raised by 100. In FIG. 5, terminal 118 also has a mounting through-hole 142, but hole 142 is substantially circular. Further, terminal 118 includes an integral collar 134 with a tapering bore 140. Collar 134, however, does not have a platform like platform 36 and simply has an upstanding wall like wall 38. Bore 140, mounting hole 142, and mounting hole 146 align, and post 114 is inserted through holes 140, 142, and 146.

FIG. 6 shows another embodiment of the present invention. Reference characters of the embodiment shown in FIG. 6 corresponding to reference characters of the embodiment shown in FIGS. 1-4 are raised by 200. The embodiment shown in FIG. 6 is substantially identical to the embodiment shown in FIG. 5. However, unlike the embodiment shown in FIG. 5, the embodiment shown in FIG. 6 includes conductor coupling end 222 having a nut and bolt arrangement for coupling an electrical conductor with terminal 218.

The present invention further provides a method of mounting battery post electrical terminal assembly 10 to a battery post 14 of a battery 16. The method includes the steps of providing, coupling, connecting, pressing, and engaging. The providing step provides that battery post electrical terminal assembly 10 includes electrical terminal 18 and retainer 10. The coupling step couples electrical terminal 18 with electrical conductor 12. The connecting step connects retainer 20 to electrical terminal 18, retainer 20 including fingers 48. The pressing step presses retainer 20 onto battery post 14. The engaging step engages fingers 48 frictionally with battery post 14 and thereby mechanically and electrically couples retainer 20 with battery post 14. Retainer 20 can define a mounting through-hole 46, fingers 48 projecting inwardly relative to mounting through-hole 46, mounting through-hole 46 receiving battery post 14. The method can further include the step of deforming fingers 48 by battery post 14 when mounting through-hole 46 receives battery post 14. Retainer 20 can include plate 42 defining mounting through-hole 46 and forming fingers 48, fingers 48 projecting from plate 42 toward battery post 14 and angled relative to plane 54 of said plate 42 so as to secure retainer 20 to battery post 14. Retainer 20 can include two mounting springs 44, and electrical terminal 18 can include two upstanding walls 30, each mounting spring 44 snap-fittingly engaging a corresponding upstanding wall 30. Retainer can be a monolithic component. Each mounting spring 44 is positioned along a corresponding edge of plate 42, runs substantially parallel to one another, and includes skid 50 and catch 52, each catch 52 having an open end generally facing each other. The method can further include providing collar 34 which is monolithic or discrete relative to electrical terminal 18, collar 34 including bore 40 therethrough which is mounted to battery post 14. Electrical terminal 18 includes mounting through-hole 32, mounting through-hole 46 of retainer 20, mounting through-hole 32 of electrical terminal 18, and bore 40 of collar 34 being aligned when battery post electrical terminal assembly 10 is coupled with battery post 14.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A battery post electrical terminal assembly, comprising:

an electrical terminal configured for coupling with an electrical conductor; and a retainer snap-fittingly engaged with said electrical terminal and including a plurality of fingers, said plurality of fingers configured for frictionally engaging a battery post of a battery and thereby configured for mechanically and electrically coupling said retainer with said battery post.

2. The battery post electrical terminal assembly of claim 1, wherein said retainer defines a mounting through-hole, said plurality of fingers projecting inwardly relative to said mounting through-hole.

3. The battery post electrical terminal assembly of claim 2, wherein said plurality of fingers are configured for being deformed by said battery post when said mounting through-hole receives said battery post.

4. The battery post electrical terminal assembly of claim 3, wherein said retainer includes a plate defining said mounting through-hole and forming said plurality of fingers, said plurality of fingers configured for projecting from said plate toward said battery post, said plurality of fingers angled relative to a plane of said plate and thereby being configured to secure said retainer to said battery post.

5. The battery post electrical terminal assembly of claim 2, further comprising a collar which is one of monolithic and discrete relative to said electrical terminal, said collar including a bore therethrough configured for mounting to said battery post.

* * * * *